United States Patent [19]

Nowak

[11] 4,231,412

[45] Nov. 4, 1980

[54] FOLDING GARAGE SCREEN DOOR

[76] Inventor: Eugene F. Nowak, 5826 Broadway, Lancaster, N.Y. 14086

[21] Appl. No.: 90,024

[22] Filed: Oct. 31, 1979

Related U.S. Application Data

[63] Continuation of Ser. No. 624,790, Oct. 23, 1975, abandoned.

[51] Int. Cl.[3] ..... E05D 15/26

[52] U.S. Cl. ..... 160/213; 160/113; 160/181; 160/374

[58] Field of Search ..... 160/189, 113, 210, 181, 160/213, 372, 374

[56] References Cited

U.S. PATENT DOCUMENTS

| | | | |
|---|---|---|---|
| 1,189,790 | 7/1916 | Carroll | 160/374 X |
| 1,252,603 | 1/1918 | Melcher | 160/210 X |
| 1,813,474 | 7/1931 | Ward . | |
| 2,334,749 | 11/1943 | Burr | 160/210 X |
| 2,881,831 | 4/1959 | Knodel, Jr. . | |
| 3,021,896 | 2/1962 | Buono et al. | 160/113 |
| 3,493,033 | 2/1970 | McGirr . | |
| 3,672,529 | 6/1972 | Feddersen et al. . | |
| 3,938,577 | 2/1976 | Richards | 160/113 X |
| 4,026,343 | 5/1977 | James | 160/189 |

*Primary Examiner*—Philip C. Kannan
*Attorney, Agent, or Firm*—Joseph P. Gastel

[57] ABSTRACT

A screen door construction for selective attachment to a garage for placement in a garage door opening including an upper screen panel, a lower screen panel hingedly secured to said upper screen panel, a hinge pivotally mounting the upper edge of the upper screen panel to the upper edge of a garage door opening, first adjuster members for permitting the adjustment of the upper and lower panels within the garage door opening so as to fit them properly to occupy the entire height of the door opening and to extend horizontally therein, second adjuster members for adjusting the width of the panels to fit properly within the width of the garage door opening, and attachment structure for selectively attaching and detaching the upper screen panel relative to the garage door opening.

23 Claims, 11 Drawing Figures

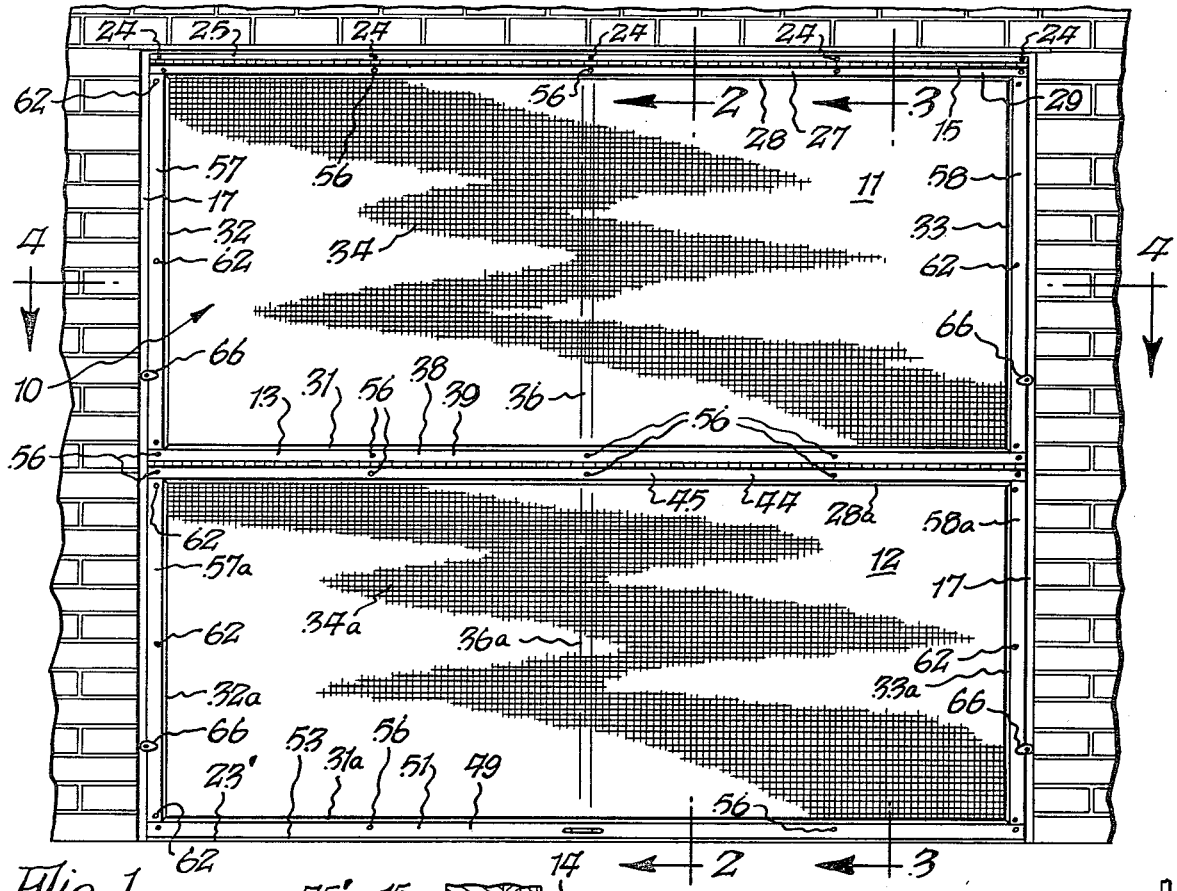
Fig. 1.
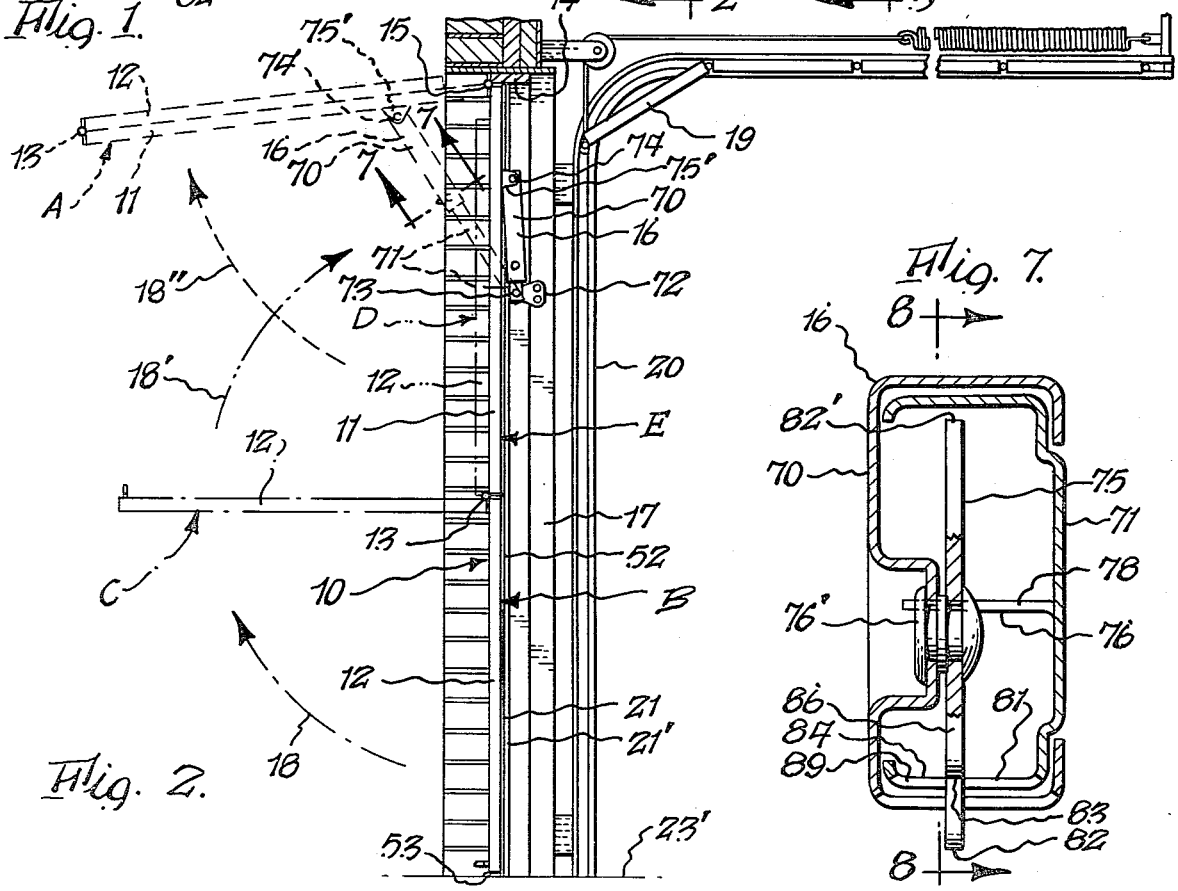
Fig. 2.
Fig. 7.

FOLDING GARAGE SCREEN DOOR

This is a continuation of application Ser. No. 624,790 filed on Oct. 23, 1975, now abandoned.

The present invention relates to an improved folding garage screen door.

By way of background, in certain climates it is desirable to selectively place a screen door on a garage in addition to the normal garage door which is generally of the overhead type. The screen door permits the garage to be used during summer months as an extra room equivalent to a screened-in porch or patio or the like. However, in the past, screen doors which were used on garages had certain shortcomings. In this respect, certain screen doors were made of a single rigid wood frame which fit into the garage door opening. Such screen doors were deficient because they were extremely heavy, and, further, once they were installed, it was extremely difficult and cumbersome to remove the screen door from the garage door opening for ingress and egress. Other types of screens for closing a garage door opening, such as those running on overhead tracks, were extremely complicated and costly to install. In addition to the foregoing, it was extremely difficult to build standard garage door screens for universal use because garage door openings vary widely in their dimensions and even those garage door openings of a particular nominal dimension vary from each other slightly either in size or in squareness. It is with overcoming the foregoing deficiencies of the prior art that the present invention is concerned.

It is accordingly one important object of the present invention to provide an improved garage screen door which can be installed to completely close a garage door opening or which can be opened easily to occupy an out-of-the-way position in the event the garage door opening is to be used for ingress or egress. A related object of the present invention is to provide an improved garage door screen which does not in any way interfere with normal operation of the existing garage door.

Another object of the present invention is to provide an improved garage screen door which can be adjusted to fit garage door openings which vary slightly in size from the nominal size thereof and which are not perfectly square.

A further object of the present invention is to provide an improved garage screen door which once installed and fitted to a garage door opening can be removed for storage in an extremely simple manner and can also be reinstalled in an extremely simple manner. Other objects and attendant advantages of the present invention will readily be perceived hereafter.

The present invention relates to a screen door construction for selective attachment to a garage for placement in a garage door opening comprising an upper screen panel having an upper edge and a lower edge, a lower screen panel for occupying a position extending horizontally below said upper screen panel, first attachment means coupling said upper and lower screen panels relative to each other so as to selectively permit said lower screen panel to move relative to said upper screen panel to thereby permit said upper and lower panels to occupy a first position wherein they cover said opening or a second position wherein they are compacted relative to each other, and second attachment means for selectively attaching and detaching said upper screen panel relative to said garage door opening.

The present invention also relates to a screen door construction for placement in a garage door opening comprising an upper screen panel having an upper edge and a lower edge, a lower screen panel for occupying a position extending horizontally below said upper screen panel, first attachment means coupling said upper and lower screen panels relative to each other so as to selectively permit said lower screen panel to move relative to said upper screen panel to thereby permit said upper and lower screen panels to occupy a first position wherein they cover said opening or a second position wherein they are compacted relative to each other, and adjuster means mounted relative to said upper and lower panels for adjusting the width thereof to fit accurately within said garage door opening.

The present invention also relates to a screen door construction for placement in a garage door opening comprising an upper screen panel having an upper edge and a lower edge, a lower screen panel for occupying a position extending horizontally below said upper screen panel, first attachment means coupling said upper and lower screen panels relative to each other so as to selectively permit said lower screen panel to move relative to said upper screen panel to thereby permit said upper and lower panels to occupy a first position wherein they cover said opening or a second position wherein they are compacted relative to each other, adjuster means mounted relative to said upper and lower panels for adjusting the height thereof to cause them to fit accurately within said garage door opening, and second attachment means for attaching said upper panel relative to the garage door opening.

The various aspects of the present invention will be more fully understood when the following portions of the specification are read in conjunction with the accompanying drawings wherein:

FIG. 1 is a fragmentary front elevational view of the improved garage screen door of the present invention positioned in a garage door opening;

FIG. 2 is a fragmentary cross sectional view taken substantially along line 2—2 of FIG. 1 and showing the folding garage screen of the present invention in (1) a position wherein it closes the entire garage door opening and (2) a position wherein it causes the entire garage door opening to be fully open and unobstructed, and (3) an intermediate position which it occupies during the screen door opening process, this Figure also showing the relationship of the folding garage screen to the normal overhead garage door;

FIG. 6 is a fragmentary enlarged view of the adjustable bottom channel which fits on the lower edge of the lower screen panel;

FIG. 7 is a cross sectional view taken substantially along line 7—7 of FIG. 2 and showing the structure of certain portions of the holders which are used to hold the screen door in an open position or permit it to occupy a closed position;

Figures 3, 4, 8, 9, 10, 11:
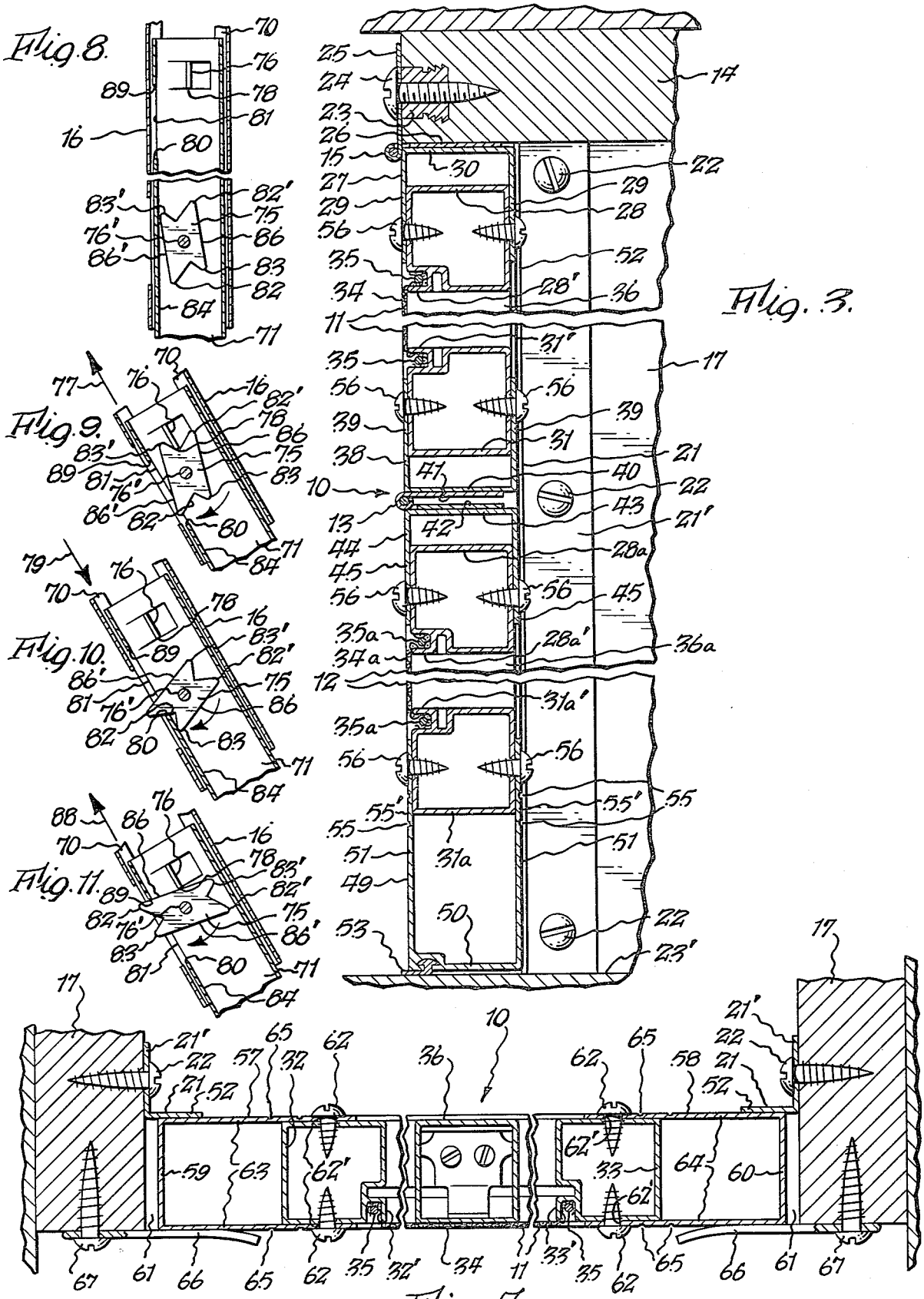
FIG. 3 is a fragmentary cross sectional view taken substantially along line 3—3 of FIG. 1 and showing various constructional details of the folding garage screen including the various adjusters for adjusting the height and the level of the folding garage screen to cause it to occupy the full height of the garage door opening.
FIG. 4 is a fragmentary cross sectional view taken substantially along line 4—4 of FIG. 1 and showing the adjusters mounted on the sides of the upper screen panel for the purpose of adjusting the width thereof to fit the garage door opening.
FIG. 8 is a fragmentary cross sectional view taken substantially along line 8—8 of FIG. 7 and showing the orientation of various portions of the holder when the screen door is fully closed.
FIG. 9 is a view similar to FIG. 8 but showing the position which the parts occupy when the garage screen door is approaching its fully open position.
FIG. 10 is a view similar to FIG. 9 but showing how the holder holds the door in the fully open position.
FIG. 11 shows the orientation of the various parts of the holder when the door is being returned to a closed position.

The improved garage screen door 10 of the present invention includes an upper panel 11 and a lower panel 12 hingedly secured thereto by horizontal piano hinge 13. Upper panel 11 is hingedly secured relative to the top molding 14 of the frame of the garage door opening by means of a piano hinge 15. Because of the foregoing construction, the folding garage screen 10 can occupy a position such as shown in FIGS. 1 and 2 wherein screen panels 11 and 12 are in a substantially coplanar orientation B relative to each other wherein they close the entire garage door opening, or the folding garage screen can be moved to an out-of-the-way position A shown in dotted lines in FIG. 2 wherein it is retained by holder members 16 mounted between the opposite side moldings 17 of the garage door opening and the upper portion of the screen panel 11.

In order to move folding garage screen 10 from the solid line position B shown in FIGS. 1 and 2 to the dotted line position A shown in FIG. 2, the bottom panel 12, as represented by dot-dash lines, is pivoted in the direction of arrow 18 until such time as it reaches an intermediate horizontal position C shown in FIG. 2, and thereafter it is moved in the direction of arrow 18', to an upright dash-dot position D where it lies in superimposed parallel relationship relative to upper screen panel 11 which is at position E, and thereafter both panels 11 and 12 are swung about upper hinge 15 in the direction of arrow 18" so that they extend at position A substantially horizontally outwardly from the upper garage door molding 14. Because of the manner in which the folding garage screen 10 operates, it can selectively occupy the position at A wherein it leaves the garage door opening totally open and unobstructed or it can occupy the totally closed position B wherein it completely closes the garage door opening. All of the foregoing can be achieved without in any way interfering with the normal operation of the overhead garage door 19 which runs on spaced parallel tracks 20 on opposite sides of the garage door opening, as is well understood.

In order to install the improved garage door screen, the following steps are performed. First of all, sides 21' of angles 21 (FIG. 4) are attached to door side moldings 17 by means of a plurality of vertically spaced screws 22. As can be seen from FIG. 2, angles 21 extend substantially the entire distance between top molding 14 and garage floor 23. Thereafter, a plurality of anchors 23 are placed in horizontally spaced relationship in top molding 14 to removably receive screws 24 which extend through leaf 25 of hinge 15, the other leaf 26 of hinge 15 being secured, as by welding, to channel member 27. Leaf 25 extends substantially the entire distance between side moldings 14.

Thereafter, the upper frame member 28 of upper screen panel 11 is slipped into channel 27. In this respect, the opposite legs 29 of channel 27 converge slightly toward each other away from base 30 so that they will frictionally grip upper frame member 28 in any position in which it is placed in channel 27. The remainder of upper screen panel 11 includes lower frame member 31 and side frame members 32 and 33. Frame members 28, 31, 32 and 33 are essentially hollow box sections (FIGS. 3 and 4) which are mitered at their ends for attachment to the adjacent frame members as by welding.

A screen 34 is held in position within upper screen panel 11 by means of a plastic molding 35 which presses the edges of screen 34 into channels 28', 31', 32' and 33' of frame sections 28, 31, 32 and 33, respectively, in a manner which is well known. A central strut 36 extends between frame members 28 and 31 for the purpose of enhancing the rigidity of upper screen panel 11, considering that it may be anywhere between 9 and 14 feet long between frame members 32 and 33.

After upper screen panel 11 has been positioned within the door opening, channel 38 is slipped onto lower frame member 31. The sides 39 of channel 38 converge toward each other away from base 40 so that they will be frictionally retained in position on frame member 31. Base 40 of channel 38 is secured, as by welding, to leaf 41 to piano hinge 13. Leaf 42 of piano hinge 13 is secured, as by welding, to base 43 of channel member 44 having legs 45 which converge toward each other away from base 43.

Thereafter, the upper frame portion **28*a* of lower screen panel 12 is slipped into channel 44 and it will be frictionally held therein because of the converging nature of legs 45. Lower screen panel 12 is identical in all respects to upper screen panel 11** and corresponding parts are designated by the same numerals followed by the notation a. It is deemed that further description of this member is therefore unnecessary.

Before lower screen panel 12 is slipped into position, lower molding channel 49 is slipped onto lower frame member **31*a*. Lower molding channel 49 includes a base 50 and legs 51 which converge toward each other away from base 50 so that after they are slipped onto frame member 31*a*, they will be frictionally held in position. Channels 30, 38, 44 and 49 are sufficiently long to permit them to be cut to length to fit about one-eighth of an inch from the side moldings 17**.

After the screen panels 11 and 12 have been placed in temporary assembled relationship relative to channel members 30, 38, 44 and 49 in position in the garage door opening so that they or the channels such as 57 and 58 mounted thereon lie flush against legs 52 of angles 21, the screen panels 11 and 12 and the various channels 38, 44 and 49 are manually aligned relative to each other until such time as piano hinge 13 extends horizontally and screen panels 11 and 12 also extend horizontally, notwithstanding that the side molding 17, upper molding 14 and floor 23 of the garage door opening may not be square relative to each other. For example, it might be that upper piano hinge 15 extends at a slight angle relative to the horizontal because upper molding 14 may be so oriented. Therefore, upper channel 27 will also extend at such an angle, but upper screen panel 11 can be oriented within channel member 27 so that it is perfectly horizontal. This can be done because upper frame member 28 need not lie squarely within channel 30. Furthermore, channel 38 is adjusted on lower frame member 31 so that piano hinge 13 is substantially horizontal. Thereafter, lower screen panel 12 is positioned within channel 44 so that this panel is substantially horizontal. Thereafter, lower channel 49 is adjusted so that its base 50 extends as parallel as possible to floor surface 23. In doing so, channel 49 may extend at an angle relative to lower frame member 31*a*. It is to be noted that a sealing strip 53 extends across the entire length of channel 49 so as to provide sealing engagement with garage floor 23.

Thus, by manipulating screen panels 11 and 12 relative to channels 27, 38, 44 and 49, the panels can be installed horizontally relative to a garage door opening which may not be square. In addition, by telescoping the various frame members 28, 31, 28*a* and 31*a* the required amounts relative to the channel members 27, 38, 44 and 49, respectively, into which they fit, adjustments can be made for causing the screen panels to fit completely into garage door openings which vary as much as a few inches from a given standard. The channel members 27, 38, 44 and 49 function in the nature of expanders because they expand the height of the panels 11 and 12. It will be appreciated that by making the legs of the various channels longer, greater adjustments may be made. In other words, the overall height of the screen door assembly can be effectively increased by telescoping the horizontal frame mmembers of the panels less into their respective channels. On the other hand, if the horizontal frame members are fully seated within their respective channels, the door 10 will have a minimum height.

The legs 51 of channel 49 have score marks 55 thereon. If the legs 51 in their installed position on lower frame member 31*a* cover any portion of the screen, 34*a*, any desired amount of legs 51 can be removed by merely scoring along any of lines 55 with a sharp tool, such as a screwdriver and peeling any number of portions, such as 55' of leg 51, away by merely pulling them with a pliers. The same structure may be used in conjunction with any of the other channels if desired.

After the alignment has been effected so that the screen panels 11 and 12 extend horizontally in the opening and so that the opposite side members of the panels 32–33 and 32*a*–33*a* are equidistantly spaced from the side moldings 17, screws such as 56 may be placed through suitable apertures (not numbered) in the various horizontally extending channels 30, 38, 44 and 49 to firmly attach them to the horizontal frame members of the screen panels.

Figure 5:
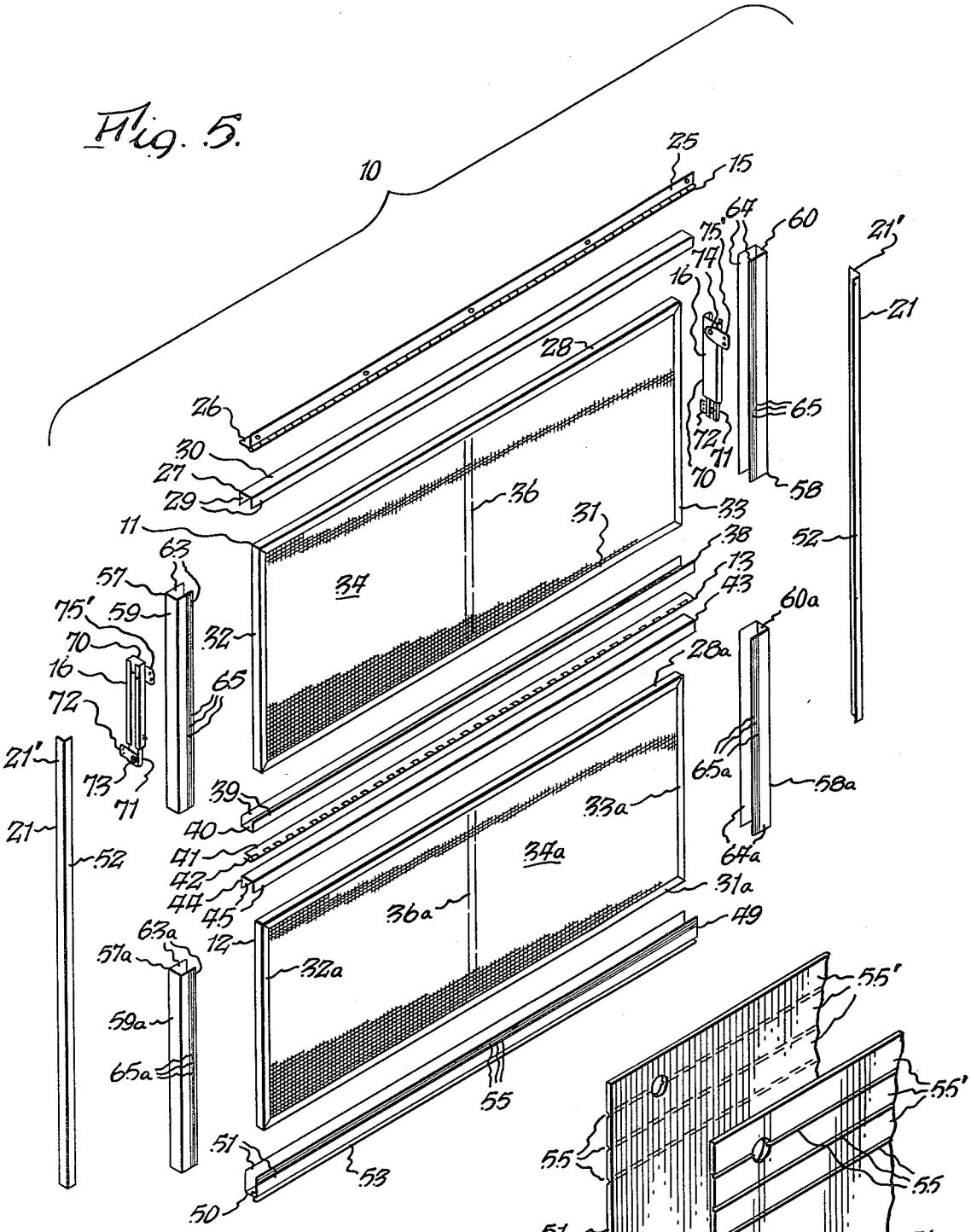
FIG. 5 is an exploded view of the various components associated with the improved garage screen door of the present invention.

After the foregoing has been accomplished, side channels 57 and 58 for upper panel 11 are cut to the proper length so that their ends will essentially abut the ends of the legs 29 and 39 of channels 27 and 38, respectively. Thereafter, channels 57 and 58, which are expanders in the sense that they expand the width of the panel, are telescoped onto sides 32 and 33 until such time as base portions 59 and 60 are spaced a predetermined distance 61 from side moldings 17, approximately one-eighth of an inch. Thereafter, screws 62 are inserted through suitable apertures 62' in legs 63 and 64 of channels 57 and 58, respectively. If the side moldings 17 are not perfectly vertical and square, channels 57 and 58 will extend at an angle to screen frame side members 32 and 33, respectively, but the entire panel 11 will appear to be square relative to the side moldings 17 because the bases 59 and 60 of channels 57 and 58, respectively, will be parallel to moldings 17. The same procedure followed above with respect to channels 57 and 58 is followed with respect to channels 57*a* and 58*a* which fit onto screen frame sides 32*a* and 33*a*, respectively. If desired, and as shown in FIG. 5, channels 57–58 and 57*a*–58*a* may include scored portions at 65 which permit peeling of the outer portions of the legs of these channels thereform, as described above in detail relative to strips 55' defined by lines 55 of channel member 49.

After the screen has been customized to the size of the garage door opening, latch members 66 are pivotally mounted on side moldings 17 by means of screws 67 (FIG. 4). Members 66 may be pivoted to a first position wherein they overlie the channel members adjacent thereto for the purpose of holding the screen 10 in position within the garage door opening. Latch members 66 may be pivoted to a second position wherein they do not overlie the channels adjacent thereto to thereby permit the screen door to be moved away from the garage door opening so that it will occupy the position A shown in FIG. 1.

In order to hold the screen in position A of FIG. 2, two holder arms 16 are provided. Holder arms 16 are effectively fastened between side moldings 17 and upper screen panel 11. In this respect, each holder arm 16 includes a larger portion 70 into which a smaller portion 71 telescopes. A bracket 72 is affixed to each side molding 17 by means of suitable screws, and bracket 72 is pivotally connected to portion 71 at 73. Arm portion 70 is pivotally connected at 74 to a bracket 75' which is attached to a channel, either 57 or 58, by means of screws or the like. A suitable detent member 75 is mounted within arm portion 70 for the purpose of holding arm portions 70 and 71 in the extended dotted line position such as shown in FIG. 2 when the screen panels occupy the position shown at A, or which permits arm portions 71 and 70 to occupy a fully telescoped position relative to each other when screen panel 11 is in the full solid line position in FIG. 2. Arm members, such as 16, are commercially available. It will be appreciated that any other suitable type of holder arm structures can be used which will hold panels 11 and 12 in position A to permit the garage door opening to be totally unobstructed or which will permit panels 11 and 12 to occupy their solid line position in FIGS. 1 and 2 wherein they completely close the garage door opening.

The holder arms 16 include the following structure: A detent member 75 is pivotally mounted on rivet 76' secured to member 70. When holder portions 70 and 71 are telescoped relative to each other so as to occupy the solid line position of FIG. 2, detent member 75 occupies the position shown in FIG. 8. When the door 10 is being opened so that it approaches position A of FIG. 1, arm portion 71 will slide out of portion 70 to approach the position shown in FIG. 9. At this time, a tang 76 which is struck up out of member 71 will move toward detent 75 as portion 70 moves in the direction of arrow 77. A point will be reached wherein tang 76 will strike vertex 78 of detent 75 and move it to the position shown in FIG. 9 from the position it occupied in FIG. 8. The foregoing occurs when the screen door is moved in a clockwise direction beyond the position A to the limit of movement as permitted by telescoping members 70 and 71 moving outwardly away from each other. Thereafter, the screen door is moved to the position A by pivoting it counterclockwise around hinge 15 so that portion 70 of the holders will move in the direction of arrow 79. This will cause lip 80 defining the edge of opening 81 in member 71 to engage surface 82 of detent 75 and move it to the position shown in FIG. 10 wherein tip 83 bears against side 84 of member 71 to lock members 70 and 71 relative to each other against further telescoping movement of member 71 into member 70. This will cause the screen door 10 to be held in position A.

To close the screen door, that is, to move it from position A to position B, all that is necessary is to pivot the screen door 10 from its position A in a clockwise direction about hinge 15 until such time as tang 76 strikes the side 86' of detent 75 and pivots it in a clockwise direction about rivet 76' until side 86 engages lip 89 of opening 81. This will limit the upward movement of outer portion 70. Thereafter, the screen door is pivoted in a clockwise direction about hinge 15 in FIG. 2 and lip 80 will engage side 86' of detent 75 to swing it back to the position shown in FIG. 8 as members 70 and 71 telescope toward each other. Detent 75 is of a configuration so that it has corresponding parts diagonally opposite each other, these corresponding parts being designated by regular numerals and corresponding prime numerals. However, as noted above, other types of holders may be used, it being understood that the only function of holders 16 is for the purpose of permitting the screen door to be held either in position A or return to position B.

It can thus be seen that the improved folding garage screen door of the present invention can be selectively installed in the garage door opening. The construction permits it to be adjusted to fit well within the garage door opening even though the latter may not be perfectly square. In addition, the improved garage screen door may be opened and closed without in any way affecting or interfering with the normal overhead door which is usually associated with a garage door opening. The improved garage screen door may be opened so that it occupies an entirely out-of-the-way position relative to the garage door opening so that ingress and egress may be had relative to the garage without any interference by the screen door. In this respect it is to be noted that when the door is in position A, it is totally out of the way. Furthermore, by adjusting the vertical position of holder arms 16 on side moldings 17, the height and angle at which the screen panels lie at position A can be adjusted. By the use of latch members 66 a good solid positioning of the panels 11 and 12 may be obtained against angle members 21. Furthermore, the screen need only remain installed during the summer months because it can be very conveniently removed from the garage door opening when desired. In this respect, all that need be done is to unscrew screws 24 which extend through hinge leaf 25 and also unscrew screws which hold members 72. The completely assembled panels 11 and 12 with all of the adjusted channels thereon can thus be removed as a unit from the door opening and can be stored in a folded condition such as it occupies at position A in FIG. 2. To reinstall the screen door at any subsequent time, all that need be done is to position hinge leaf 25 along top molding so that screws 24 can be reinserted through them and into anchors 23, and thereafter reposition members 72 and reattach them to the side moldings 17. The entire process of installing or removing a completely assembled screen door should not take more than a few minutes at the very most.

It can thus be seen that the improved garage screen door of the present invention is manifestly capable of achieving the above enumerated objects and while preferred embodiments of the present invention have been disclosed, it will be appreciated that it is not limited thereto but may be otherwise embodied within the scope of the following claims.

What is claimed is:

1. A screen door construction for placement in a garage door opening having a frame comprising upper screen panel means having an upper edge and a lower edge, lower screen panel means having an upper edge and a lower edge, hinge means connecting said lower edge of said upper panel means to said upper edge of said lower panel means, and adjuster means proximate said hinge means for permitting the position of said lower screen panel means to be adjusted relative to said upper screen panel means.

2. A screen door construction as set forth in claim 1 wherein said hinge means comprises a piano hinge.

3. A screen door construction as set forth in claim 2 including second piano hinge means connecting said upper edge of said upper screen panel means to said frame, and second adjuster means connected to said second piano hinge means for permitting the position of said upper screen panel means to be adjusted relative to said frame.

4. A screen door construction as set forth in claim 3 including third adjuster means for adjusting the width of said upper screen panel means to fit in said garage door opening, and fourth adjuster means for adjusting the width of said lower screen panel means to fit in said garage door opening.

5. A screen door construction as set forth in claim 3 wherein said second adjuster means comprise channel means for receiving said upper edge of said upper panel means.

6. A screen door construction as set forth in claim 3 wherein said adjuster means comprise first channel means for receiving the lower edge of said upper panel means, and second channel means for receiving the upper edge of said lower panel means.

7. A screen door construction for a garage door opening having a frame comprising upper screen panel means having an upper edge and a lower edge, lower screen panel means having an upper edge and a lower edge for occupying a position extending horizontally below said upper screen panel means, first attachment means coupling said upper and lower screen panel means relative to each other so as to selectively permit said lower screen panel means to move relative to said upper screen panel means to thereby permit said upper and lower screen panel means to occupy a first position wherein they cover said opening or a second position wherein they are compacted relative to each other, second attachment means for attaching said upper panel means relative to said garage door opening, and adjuster means for adjusting the position of at least one of said upper and lower screen panel means relative to said first attachment means to cause said lower panel means to fit accurately within said garage door opening when said upper and lower panel means are in said first position.

8. A screen door construction as set forth in claim 7 wherein said first attachment means comprises hinge means connecting said upper edge of said lower panel means to said lower edge of said upper panel means.

9. A screen door construction as set forth in claim 8 wherein said adjuster means are proximate said hinge means and wherein said adjuster means include at least one elongated strip-like member which extends along a substantial length of at least one of said lower edge of said upper screen panel or said upper edge of said lower screen panel.

10. A screen door construction as set forth in claim 8 wherein said adjuster means are proximate said hinge means and wherein said adjuster means include elongated strip-like members which extend along substantial lengths of said lower edge of said upper screen panel and said upper edge of said lower screen panel.

11. A screen door construction as set forth in claim 8 wherein said adjuster means comprises channel means coupled to said hinge means.

12. A screen door construction as set forth in claim 11 wherein said channel means comprises a channel for receiving said upper edge of said lower panel means.

13. A screen door construction as set forth in claim 11 wherein said channel means comprises a channel for receiving the lower edge of said upper panel means.

14. A screen door construction as set forth in claim 11 wherein said channel means comprises a first channel for receiving the upper edge of said lower panel means and a second channel for receiving the lower edge of said upper panel means.

15. A screen door construction as set forth in claim 7 wherein said second attachment means comprises hinge means for attaching said upper edge of said upper screen panel means to said frame.

16. A screen door construction as set forth in claim 15 including second adjuster means coupled to said hinge means for adjusting the position of said upper screen panel means in said door opening.

17. A screen door construction as set forth in claim 16 wherein said first attachment means comprises second hinge means connecting said upper edge of said lower panel means to said lower edge of said upper panel means.

18. A screen door construction as set forth in claim 17 wherein said adjuster means comprises channel means coupled to said hinge means.

19. A screen door construction as set forth in claim 17 including third adjuster means for adjusting the width of said upper screen panel means to fit said door opening, and fourth adjuster means for adjusting the width of said lower panel means to fit said door opening.

20. A screen door construction for selective mounting relative to the frame associated with a garage door opening independently of and outside of a normal garage door which can function in its normal manner while said screen door construction remains mounted in all operative positions thereof comprising an upper screen panel having an upper edge and a lower edge, a lower screen panel for occupying a position extending horizontally below said upper screen panel attachment means coupling said upper and lower screen panel means relative to each other so as to selectively permit said lower screen panel to move relative to said upper screen panel to thereby permit said upper and lower screen panels to occupy a first position wherein they close said opening or a second position wherein they are compacted relative to each other so as not to close said opening, temporary attachment means for selectively temporarily mounting and demounting said upper screen panel on said frame associated with said garage door opening, said lower screen panel including an upper and lower edge, said attachment means comprising first hinge means effectively joining said lower edge of said upper panel to said upper edge of said lower panel, said temporary attachment means comprising second hinge means coupled relative to said upper edge of said upper panel, means for temporarily affixing said second hinge means relative to said door frame for solely permitting pivotal movement of said upper panel relative to said frame, said lower panel being of substantially no greater height than said upper panel, said first hinge means permitting said lower panel to lie in substantially parallel relationship to said upper panel in said second position or in substantially coplanar relationship therewith in said first position, holding means for selectively holding said upper panel in an outwardly pivoted position from said garage door opening, and adjuster means for adjusting the position of at least one of said upper and lower screen panels relative to said attachment means to cause said lower panel to fit accurately within said garage door opening when said upper and lower panels are in said first position.

21. A screen door construction as set forth in claim 20 wherein said upper and lower panels extend substantially entirely across the width of said garage door opening and wherein said upper and lower panels each have opposite side edges, and molding means attached to opposite sides of said garage door frame for effective engagement by said opposite side edges when said upper and lower panel means are in said substantially coplanar position.

22. A screen door construction as set forth in claim 21 including fastening means mounted on said opposite sides of said garage door frame for engaging said opposite side edges to maintain said upper and lower panel means in said coplanar position.

23. A screen door construction as set forth in claim 21 wherein said first hinge means are oriented relative to said upper and lower panels to cause said lower panel to lie on top of said upper panel when said upper panel is in said outwardly pivoted position.

* * * * *